United States Patent [19]

Bondpers et al.

[11] 4,178,338

[45] Dec. 11, 1979

[54] METHOD OF CASTING THIN-WALLED, HOLLOW CONCRETE POSTS

[75] Inventors: Per-Erik Bondpers; Göte Liljegren, both of Växjö, Sweden

[73] Assignee: A-Betong AB, Växjö, Sweden

[21] Appl. No.: 875,724

[22] Filed: Feb. 7, 1978

[30] Foreign Application Priority Data

Feb. 7, 1977 [SE] Sweden ..... 7701342

[51] Int. Cl.[2] ..... B28B 1/08

[52] U.S. Cl. ..... 264/42; 249/143; 249/144; 264/72; 264/336; 425/432

[58] Field of Search ..... 249/143, 144; 425/432; 264/71, 72, 336, 42

[56] References Cited

U.S. PATENT DOCUMENTS

| | | | |
|---|---|---|---|
| 1,593,696 | 7/1926 | Hyden | 249/143 X |
| 2,356,852 | 8/1944 | Hutchinson | 425/262 X |
| 2,794,231 | 6/1957 | Lloyd | 425/435 X |
| 3,260,494 | 7/1966 | Deigaard | 249/143 X |
| 3,933,969 | 1/1976 | Robinson | 264/336 X |
| 4,039,642 | 8/1977 | Steiro | 264/71 |

FOREIGN PATENT DOCUMENTS

| | | | |
|---|---|---|---|
| 297294 | 4/1917 | Fed. Rep. of Germany | 425/262 |
| 506391 | 12/1954 | Italy | 249/143 |

*Primary Examiner*—Thomas P. Pavelko

*Attorney, Agent, or Firm*—Sughrue, Rothwell, Mion, Zinn and Macpeak

[57] ABSTRACT

In a method of casting in a horizontal mould a hollow, reinforced tapering concrete post having a thin wall and particularly a length exceeding 10 to 15 m, there is placed in the mould a tapering reinforcing cage or basket in which a core, e.g. a steel core, is inserted to form a substantially annular mould chamber. Said mould chamber is closed with the exception of an upper filling slot. A readily pourable concrete mass is charged to the mould from above through said filling slot. The mould is then vibrated without being rotated such that concrete fills the annular mould chamber. Hardening of the concrete is accelerated by heating, and the core is withdrawn from the formed post before the concrete has completely hardened. The finished post is then removed from the mould. The concrete mixture used shall have a settling or slump measurement of between 1 and 5 cm prior to charging a flow-promoting agent, and a settling or slump measurement of between 12 and 14 cm subsequent to charging said flow-promoting agent. The concrete mixture has a stone size of at the most 8 mm. The core is preferably withdrawn 1.5 to 4 hours after completion of the casting operation.

The invention also concerns a mould for casting concrete posts of the above mentioned kind.

4 Claims, 5 Drawing Figures

METHOD OF CASTING THIN-WALLED, HOLLOW CONCRETE POSTS

Figure 1:
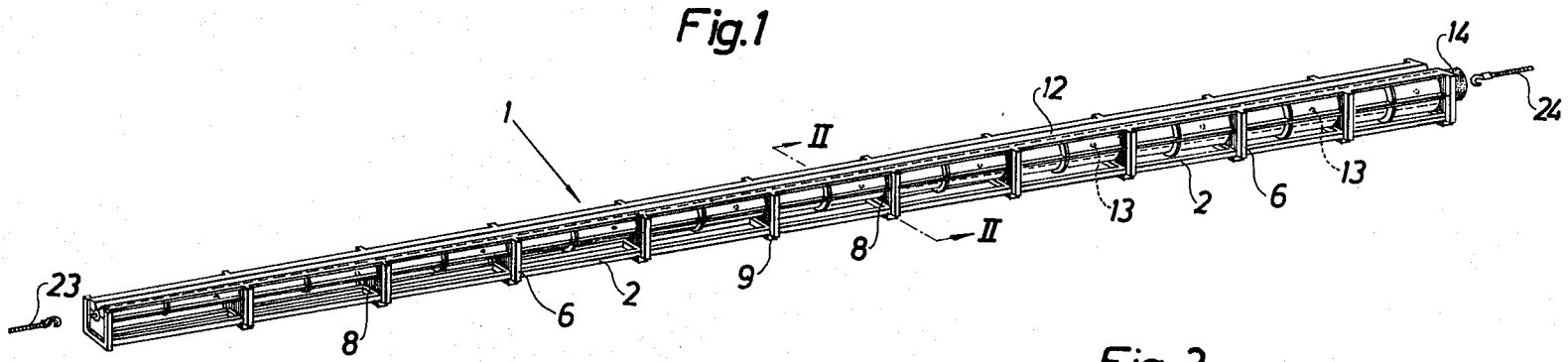

The present invention relates to a method of casting hollow, reinforced, tapering concrete posts in a horizontal mould, said posts having a thin wall when seen in cross-section and a length exceeding 10–15 meters, wherein there is placed in the mould a tapering reinforcing cage or basket in which there is inserted a core, e.g. a steel core, to form a substantially annular mould chamber which is closed with the exception of an upper filling slot.

Concrete posts are in many respects superior to wooden posts, for example posts which are to carry power lines, especially in the case of particularly long posts. Concrete posts can be used advantageously to support electric supply lines carrying 20 kV or more. In the case of posts for supporting power lines of smaller dimensions, the question as to whether it is more profitable to use a wooden post than a concrete post, or vice versa, depends, among other things, how the technique used to mount the lines on the post can be developed, primarily with regard to transport and assembly. In this connection there is mainly required a technique by which the greater weight of a concrete post vis-a-vis a wooden post can be assessed, which technique is still not fully developed. When this technique is fully developed, it is probable that concrete posts will represent a competitive alternative to wooden posts even in the case or posts of smaller lengths.

Tests which have been carried out in order to compare the extent to which wooden posts and concrete posts bend when subjected to identical loads have shown that bending of the wooden posts is substantially the same as the pure elastic deformation of the concrete posts. The deformation strength of a concrete post is thought to be greater than that of a corresponding wooden post.

It is previously known to cast hollow concrete posts in a rotary mould, in which centrifugal force is used to compress the concrete. The mould used in such a casting operation is adapted to rotate at a comparatively high speed. Such a mould arrangement is exceedingly expensive, as a result of the costs of the mould and, furthermore, places comparatively higher requirements on the properties of the concrete used. In addition hereto, the thickness of the concrete layer cannot be controlled accurately enough, which results in an unnecessarily high consumption of material and an unnecessarily heavy post. This also unfavourably affects the costs required for transporting and erecting said post. As a result of the high investment costs, the use of rotary moulds when casting has hitherto only been applied when casting posts of smaller lengths and with large marketing volumes.

Hitherto, attempts to cast hollow concrete posts comprising a thin, reinforced layer of concrete and having relatively large lengths, in a stationary mould have not been successful, among other things because of the difficulty in filling the mould correctly (prior to the concrete partially hardening). In this case, there is required a central core surrounded by a reinforcing cage whereby, since the mould extends horizontally, there is a risk that the concrete supplied to the mould from above will fill the lower part of the annular mould chamber in an incomplete manner.

An object of the present invention is to provide ways and means of casting concrete posts of the aforementioned type having thin-walls when seen in cross-section, whilst avoiding the disadvantages associated with previously applied methods.

The method is mainly characterised by the fact that a readily pourable concrete mass is charged to the mould from above through said filling slot; that the mould is vibrated without being rotated in a manner such that the concrete fills the annular mould chamber; that hardening of the concrete is hastened by heating the same; that the core is withdrawn from the formed post before the concrete has fully hardened; and in that the finished post is removed from the mould.

Thus, the present invention provides a method of also moulding posts of long lengths and with a thin-wall as seen in cross-section, with a good surface finish and accuracy, in a horizontal mould, which has hitherto been considered impossible.

Preferably there is used a concrete mixture which, prior to adding a flow-promoting substance, has a settling measurement of between 1 and 5 cm and, subsequent to adding said substance, of between 12 and 14 cm. In this way, the annular mould chamber is filled satisfactorily despite the fact that the concrete has to follow a curved path during filling of the mould chamber.

It is also preferred to use a concrete mixture of which the aggregate has a maximum stone size of 8 mm, there being used in practice a concrete mixture in which the total amount of aggregate, the percentage of 1 gravel having a maximum stone size of 4 mm is 40–50% and the percentage of stones having a size of at most 8 mm is 60–50%.

It has been found particularly difficult in practice to remove the core from the cast concrete posts. If one waits too long to draw the core out, there is a risk of the core being cast in the concrete element in a manner which prevents it from being removed without seriously damaging said element. It has been found in practice, however, that withdrawal of the core can be facilitated by applying a vibration method and, in conjunction therewith, removing the core before too much time has lapsed.

In accordance herewith it is proposed in accordance with the invention that the mould is first vibrated for 10 to 25 min and then allowed to remain stationary for 15 to 30 min, whereafter the mould is again vibrated for 2 to 3 min and the core withdrawn from 1.5 to 4 hours after the casting operation. When applying this method, it has been found that only a comparatively small pulling force, in the order of magnitude of 2 to 3 tons, is needed to release the core from the solidifying concrete. This force can be provided by a simple jack which, via a wire or the like, acts upon the thick end of the core while the cast concrete element is still in the mould. Subsequent to the core being released from the concrete element, it can be readily completely removed therefrom by means of a suitable winch arrangement.

Other difficulties encountered when casting such concrete posts is the placement of the core in the mould and the reinforcing cage surrounding said core. Since the core must be supported in some manner within the mould, and since the core is normally too heavy to be supported solely at the ends thereof, it will be understood that great difficulty is experienced in placing the reinforcing cage in position after the core has been inserted in the mould. It is therefore proposed in accordance with the invention that the reinforcing cage is placed first in the mould, which can be effected by lowering the reinforcing cage vertically into said mould, which to this end is provided with collapsable side walls. Subsequent to positioning the reinforcing cage in the mould, the core is dragged into the cage arranged in the mould. The core may also be drawn into the mould by means of a winch arrangement.

In order to make it more easy to draw the core into the mould it is proposed, in accordance with the invention, to provide the conical mould sides with a plurality of radially extending distance means arranged to support and guide the core as this is drawn into the mould, said distance means being arranged to penetrate the post before it solidifies, to form radially extending holes in the ready-cast concrete post.

These holes can then be used for lifting the post from the mound and, for example, to facilitate the mounting of electrical cables etc. when erecting the concrete post, and also to facilitate twisting of the post as it is erected.

The concrete present in the upper pouring slot of the mould can be smoothed out and permitted to solidify to form an elongate, raised strip on the finished concrete post. Such a strip, which thus causes a deviation from the correct conical shape of the post, can be used, for example, to facilitate the orientation of the post relative to the electrical cables, and to ensure flat abutment of the post against a support when storing and transporting the post, and for fixing cross bars on the posts.

The width of the strip is conveniently 40–80% of the radius of the concrete post as measured at any point on said post.

The invention also relates to a mould for casting hollow, reinforced, tapering concrete posts having a thin wall when seen in cross-section and particularly for casting such a post whose length exceeds 10–15 m, said mould being intended for carrying out the method according to the invention. The main characterising features of the mould are disclosed in the accompanying claims.

Figure 2:
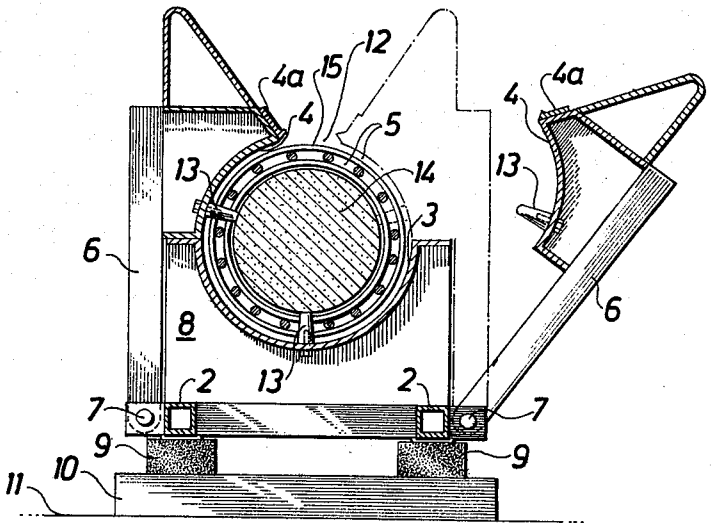
Figure 3:
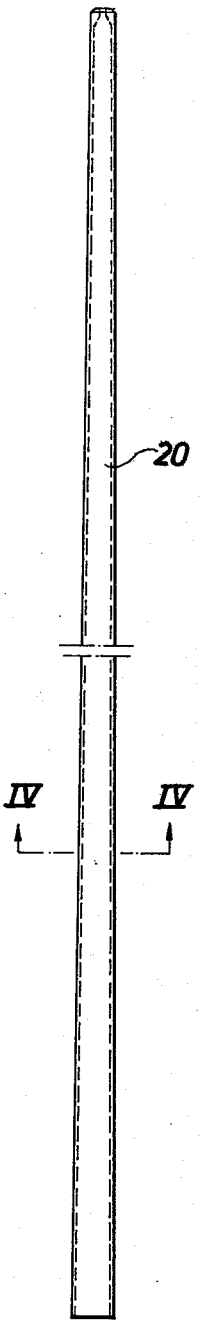
Figure 5:
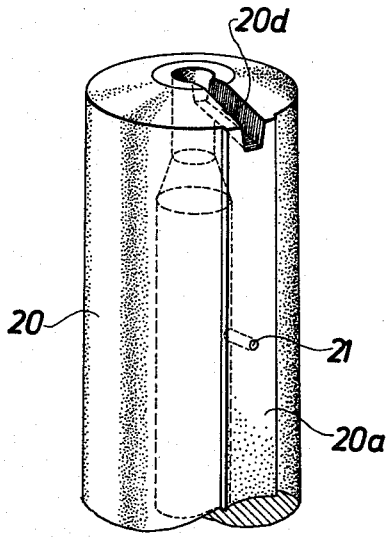
Figure 4:
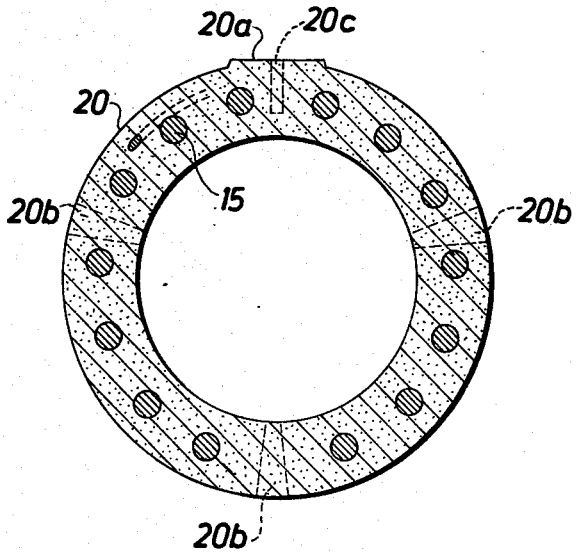

So that the invention will be more readily understood and further features thereof made apparent, an exemplary embodiment of the invention will now be described with reference to the accompanying schematic drawings, in which:

FIG. 1 is a perspective view of a horizontal mould for casting an elongate, hollow, reinforced conical concrete post having a thin wall when seen in cross-section, FIG. 2 is a sectional view taken on the line II—II in FIG. 1, FIG. 3 is a view of a concrete post cast in a mould according to FIGS. 1 and 2, FIG. 4 is a cross-sectional view in larger scale through the post on a line IV—IV in FIG. 3, and FIG. 5 is a perspective view of part of the upper portion of the post.

In FIG. 1 there is illustrated a mould for casting a hollow, conical concrete post having a length exceeding 10 to 15 m. The mould comprises a frame 2 having a bottom part 3 and two pivotable side parts 4, which together define a conical mould chamber 5 tapering from one end. The side parts 4 are arranged on rods or beams 6 arranged to pivot about a shaft 7 in the frame 2. The mould 1 also exhibits a plurality of part-circular flanges 8 which divide the mould into sections. The mould rests on a longitudinally extending vibration damping means 9 supported against beams 10 on a floor 11.

In their lifted position, the side parts 4 seal accurately with the bottom part 3. In the lifted position of the said side parts they are mutually spaced at the upper part of the mould to form a longitudinally extending filling slot 12 through which concrete is poured into the chambers. To this end the mould parts 4 are each provided with a longitudinally extending strip **4*a*** of substantially triangular profile, whereby the side edges of the longitudinally extending strip obtain the desired clearance.

The bottom part 3 and the side parts 4 of the mould are provided with a plurality of radially extending distance means each of which has the form of a conical pin 13. These distance means are adapted to support a core 14 in the form of a conical body, e.g. made of steel. The core is intended to be drawn into the mould from the thick end thereof by means of a winch arrangement (not shown) having a hook 23 and located at the other end of the mould. Prior to drawing in the core, however, there is placed in the mould a reinforcing cage or basket 15. The cage is inserted into the mould by collapsing the side parts 4 thereof, whereafter said cage is lowered vertically into the mould chamber by means of a crane for example. Alternatively, the reinforcing cage may also be drawn into the mould from one end thereof. In this case, however, the distance means 13 must be so arranged as to enable them to be temporarily removed from the mould chamber 5.

When casting a post, a readily pourable concrete mass is charged to the mould, said mass falling into said mould via the upper filling slot 12. The mould is then vibrated in a manner to cause the concrete to flow therealong. Hardening of the concrete is hastened by heating the same. Thus, the lower part of the mould may be heated, for example, by means of pipes (not shown) arranged on the outside of the mould and adapted to carry steam or hot water. Alternatively, or in addition hereto, the core may be heated or the concrete may be heated prior to being charged to the mould.

Prior to charging the flow-promoting substance, the concrete mixture used shall have a settling measurement of between 1 and 5 cm. Subsequent to charging the flow-promoting substance, the concrete mixture shall have a settling measurement of between 12 and 14 cm. The aggregate used in the concrete mixture is partly gravel having a stone size of at most 4 mm and partly stones having a size of at most 8 mm. The percentage of gravel used shall be 40 to 50% whilst the percentage of stones shall be 60 50% of the total quantity of aggregate used.

The percentage of cement shall be 16 to 20% by weight of the concrete mixture, while the percentage of water shall be 4 to 8% by weight of said mixture.

Further, the concrete mixture will contain a foaming or pore-building agent. The percentage of flow-promoting agent shall be 1.5–3% of the total weight of cement in the mixture.

During the filling operation, the mould is first vibrated for 10 to 25 minutes, whereafter it is permitted to remain stationary for 15 to 30 minutes, and then again vibrated for a further 2 to 3 minutes. From 1.5 to 4 hours after the casting operation has been completed, the core 14 is released from the cast concrete post. For this purpose there is used a jack (not shown) arranged to exert a force on the thickened of the post via a hook 24. At this point of time the concrete in the post will have hardened to an extent such that the core can be released without damaging the post, and the core has not yet permanently fastened to the post. It is sufficient for the jack to loosen the core. The core can then be removed from the post by means of a suitable winch arrangement (not shown).

A power-line pylon or post 20 manufactured in the mould illustrated in FIGS. 1 and 2 is shown in FIGS. 3 to 5. The post, which is hollow and tapers conically, has a circular cross-section, with the exception of a longitudinally raised strip 20*a* formed in the upper pouring slot 12 of the mould. In the illustrated embodiment, the width of the strip 20*a* is slightly larger than half the radius of the post at that location on the post at which the section IV—IV has been placed. The width of the strip, however, may vary between 40 and 80% of the radius of the concrete post taken at any selected point therealong.

The conical distance means or core supports 13 located in the mould form corresponding holes 20*b* in the cylindrical surface of the post. These holes can be utilised for different purposes when erecting the post.

Disposed in the longitudinally extending strips 20*a* is a plurality of holes 20*c* in which securing sleeves for electrical-earth lines can be attached. Arranged at the upper end of the concrete post, as seen when erected, is a radial groove 20*d* which serves as an exit for an earth cable extending within the hollow post. The described casting method, which presumes the use of a core which is removed subsequent to the casting operation, offers the added advantage over a casting operation in which the mould is rotated insofar as both the external shape of the post and the cavity can be varied geometrically.

The above description has been made with reference to a conical concrete post of great length and having a substantially cylindrical cross-section, although somewhat asymmetric as a result of the longitudinally extending strip 20*a*. It is also possible within the scope of the concept of the invention to manufacture tapering concrete posts of a different profile than that shown. For example, in certain cases, the concrete mass present in the filling slot 12 can be smoothed in such a way that the finished post has a substantially symmetrical cross-section, i.e. lacks the raised strip 20*a* or has a strip which is not so pronounced. Alternatively, it is possible to manufacture tapering concrete posts having other cross-sectional shapes, for example of polygonal cross-section, which may either be regular or irregular and present or lack a longitudinally extending strip corresponding to the strip 20*a*.

The thickness of the walls of the concrete post need, in practice, only slightly exceed the thickness of the reinforcing means. In the case of a concrete post having a length of 20 m and a total weight of approximately 2 tons, the reinforcing means will weigh approximately half, i.e. 1 ton, while the weight of the actual concrete mass will also weigh approximately 1 ton. For particular purpose, the wall of the post may be thicker and may approach the values which constitute the minimum values for a post manufactured in a rotatable mould. One of the most important advantages afforded by the invention, however, is that tapering concrete posts having a thin-wall in cross-section can be cast and that posts whose measurements are much more accurate and whose surface finish is much better than that which can be obtained when casting in a rotary mould can be obtained when casting in accordance with the present invention.

What is claimed is:

1. A method of casting a hollow, reinforced, tapering concrete post having a thin wall and a length exceeding 10 m in a hoirzontal mould, a tapering reinforcing cage being disposed in the mould and a core of steel or the like being disposed within the reinforcing cage and centered within the mould by a plurality of support posts extending radially inwardly from the sides of the mould to thereby define an annular mould chamber having an elongated filling slot running along the upper side thereof, comprising the steps of:

(a) charging a readily pourable concrete mass into the annular mould chamber through the filling slot, said concrete mass comprising 16 to 20% by weight of cement, 4 to 8% by weight of water, a sufficient amount of flow-promoting agent to provide a slump measurement of between 12 and 14 cm, and an aggregate having a maximum size of 8 mm including 40 to 50% of said aggregate being gravel having a maximum size of 4 mm, (b) vibrating the mould for 10 to 25 minutes without rotating it to settle the concrete mass and evenly fill the annular mould chamber, (c) simultaneously and thereafter heating the concrete mass to accelerate its hardening, (d) allowing the mould to remain stationary for 15 to 30 minutes, (e) revibrating the mould for 2 to 3 minutes, (f) withdrawing the core from the post 1.5 to 4 hours after the charging of the concrete mass and before it has completely hardened, and (g) removing the finished post from the mould.

2. A method according to claim 1, characterised by the concrete mass containing a foaming agent, and said flow-promoting agent comprising 1.5–3.0% by weight of the cement.

3. A method according to claim 1, characterised by smoothing out the concrete mass present in the upper filling slot of the mould and permitting it to solidify to form a longitudinally extending, raised strip on the finished concrete post.

4. A method according to claim 3, characterised by dimensioning the width of the strip to be 40 to 80% of the radius of the concrete post at any random point therealong.

* * * * *